United States Patent [19]

Goldfarb

[11] 4,266,776

[45] May 12, 1981

[54] MULTI TARGET-SHOOTER GAME APPARATUS

[76] Inventor: Adolph E. Goldfarb, 4614 Monarca Dr., Tarzana, Calif. 91356

[21] Appl. No.: 11,065

[22] Filed: Feb. 12, 1979

[51] Int. Cl.[3] ..... F41J 5/02

[52] U.S. Cl. ..... 273/310; 273/406; 364/410

[58] Field of Search ..... 364/410; 273/101, 101.1, 273/101.2, 102.1 R, 102.2 R, 102.2 B, 105.2, 85 G, 105.6, 102.1 F, 310–316, DIG. 28, 406; 35/25; 340/323 R

[56] References Cited

U.S. PATENT DOCUMENTS

| | | | |
|---|---|---|---|
| 3,653,026 | 3/1972 | Hurley | 340/323 R |
| 3,802,098 | 4/1974 | Sampson et al. | 273/102.2 |
| 3,811,204 | 5/1974 | Marshall et al. | 273/101.1 |
| 3,870,305 | 3/1975 | Harclerode | 273/101.1 |
| 3,914,879 | 10/1975 | Taylor et al. | 35/25 |
| 3,959,640 | 5/1976 | Syria | 340/323 R |
| 3,960,380 | 6/1976 | Yokoi | 273/101.1 |
| 4,026,555 | 5/1977 | Kirschner et al. | 273/102.2 R |
| 4,099,713 | 7/1978 | Spector | 340/323 R |
| 4,147,355 | 4/1979 | Barlow et al. | 273/101.1 |

*Primary Examiner*—Charles E. Atkinson
*Assistant Examiner*—Gary Chin
*Attorney, Agent, or Firm*—Romney, Schaap, Golant, Disner & Ashen

[57] ABSTRACT

A multitarget shooter game apparatus comprising a light beam gun and a plurality of separate targets in the form of light sensitive cells which can be positioned at substantial distances from one another, preferably in different directions from a shooting position where the gun is located. The targets units include housings for the cells and the cells may be adjustably positioned in the housings to account for ambient light conditions. The targets indicate, as by illuminating an LED, when they are active and can be shot at to produce a score and when they are inactive. In one form the targets are each alternatively active for a short time in a random or apparently random order. Thus, the shooter must respond quickly, aim and fire in different directions as the different targets become active. The targets are unconnected to one another except for wires which electrically connect the targets to a control and scoring unit which may include a microprocessor for activating and deactivating the targets, for keeping score of when an activated target is hit (or not hit), for providing score results, and for providing visual and/or auditory accompanying output such as "get ready", "a hit", etc. Each time the gun is fired, the light beam goes on for only a very short time, which requires taking distinct shots rather than scanning.

13 Claims, 17 Drawing Figures

MULTI TARGET-SHOOTER GAME APPARATUS

BACKGROUND OF THE INVENTION

1. Field of the Invention

This invention relates in general to certain new and useful improvements in target game apparatus, and more particularly, to multiple target-shooter game apparatus in which a shooter is positioned to selectively shoot at a plurality of targets when the latter are in an active state.

2. Brief Description of the Prior Art

There have been a number of commercially available target-shooter games apparatus, that is game apparatus in which a shooter mechanism, as for example a gun or simulated gun, is positioned to shoot at a plurality of targets. For example, in shooting galleries, rifles, e.g., 22 caliber rifles, are used to shoot at a plurality of targets which in many cases are moving.

There have been many commercially available games for children in which shooters are positioned to shoot at a plurality of toy targets.

With the advent of microprocessors, there have been a number of commercially available games which are adapted for operation in conjunction with a conventional television set and which are adapted to generate moving images across the television screen which are representative of targets. A shooter mechanism in the form, typically of a gun, is provided for aiming and shooting at the moving target on the television screen in order to enable the player to generate a score when the gun is properly aimed and shot. In these games, an optical-electrical circuit is created between the shooter mechanism and the moving target on the television screen when the shooter mechanism is properly positioned with respect to the target.

These games which are adapted for operation with a conventional television set are fairly expensive. Moreover, they prevent normal television viewing when the game apparatus is being played. More importantly, these game apparatus which are adapted for use in conjunction with conventional television sets are generally permanently connected to the television set and usually are interposed in the antenna system of the television set. Accordingly, whether or not the game apparatus is turned on, they materially interfere with normal television reception of the television set.

OBJECTS OF THE INVENTION

It is, therefor, a primary object of the present invention to provide an improved target-shooter game apparatus which is comprised of spaced apart targets along with a shooter mechanism, and which targets are randomly or apparently randomly activated for the player to attempt to shoot successively at the activated targets.

It is another object of the present invention to provide a game apparatus of the type stated in which each of the plurality of targets can be spaced apart from each other by substantial distances and positioned at any desired location relative to a shooter mechanism.

It is a further object of the present invention to provide a game apparatus of the type stated in which each of the plurality of targets are connected to a control and scoring mechanism which includes a microprocessor for activating and deactivating the targets and also for keeping score when an activated target is hit with the shooter mechanism.

It is also an object of the present invention to provide a game apparatus of the type stated in which the targets are each provided with a light sensitive cell and the shooter mechanism generates a light beam adapted to hit the light sensitive cells on the targets in order to generate a score.

It is another salient object of the present invention to provide a game apparatus of the type stated which can be manufactured at a relatively low cost and which is highly reliable in operation.

It is an additional object of the present invention to provide a game apparatus of the type stated which includes a mechanical adjustment feature to vary the sensitivity of the light sensitive cells on the targets to accomodate various ambient light levels and conditions.

It is another object to provide a game apparatus of the type stated where the shooter mechanism provides a light beam for only a very short period each time it is fired, to require the user to fire only distinct shots.

With the above and other objects in view, my invention resides in the novel features of form, construction, arrangement and combination of parts presently described and pointed out in the claims.

SUMMARY OF THE INVENTION

A multiple target shooter game apparatus in which each of a plurality of targets is in the form of a light sensitive cell and the shooter mechanism generates a beam of light such that when the beam of light is directed to and impinges upon the light sensitive cell, a score may be generated. The targets are unconnected except for electrical wires which connect the targets to one another. Moreover, the targets may be positioned at substantial distances from each other and in different directions relative to the shooter mechanism.

The targets are randomly or apparently randomly activated for a limited time and a signal is generated with respect to a particular target when it is activated. For example, the signal which indicates the activation of a target may be a light emitting diode or similar light which is energized to provide indication that the particular target has been activated. Further, each time the shooter mechanism is operated, the light beam is flashed on and off very quickly and it does not stay on. Thus, the player must first quickly aim the shooter mechanism at the activated target cell, and then fire the mechanism. A mechanical arrangement is provided for adjusting the position of each target cell in accordance with light conditions where the apparatus is being used.

A control and scoring unit is associated with and electrically connected to the plurality of targets. The control and scoring unit is adapted to very quickly activate the various targets in a random or apparently random order which gives rise to a fast play of the game and substantial excitement. The control and scoring unit also keeps score for the player who is shooting at the targets. A mode control switch may be provided to set the game for play in various speed modes, e.g., a fast mode or a slow mode.

When a score is generated, it may be depicted visually or audibly or both ways by suitable means. In this case, the scoring and control unit includes a microprocessor and might also be provided with a speaker for providing auditory messages such as scores or amusing sounds or the like.

The invention possess many other advantages and has other purposes which may be made more clearly apparent from a consideration of one or more forms in which it may be embodied. These forms are shown in the drawings accompanying and form a part of the present application. They will now be described in detail for purposes of illustrating the general principles of the invention; but it is to be understood that such detailed descriptions are not to be taken in a limiting sense.

BRIEF DESCRIPTION OF THE DRAWINGS

Figure 1:
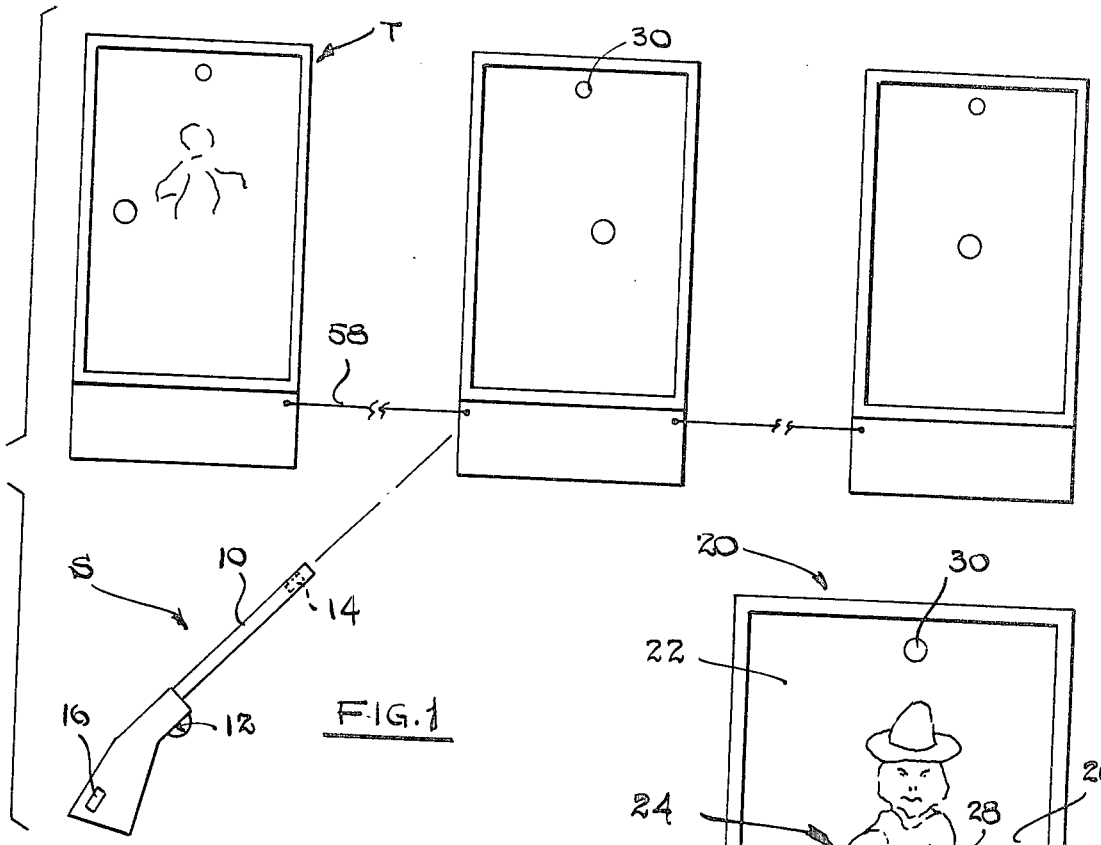
Figure 2:
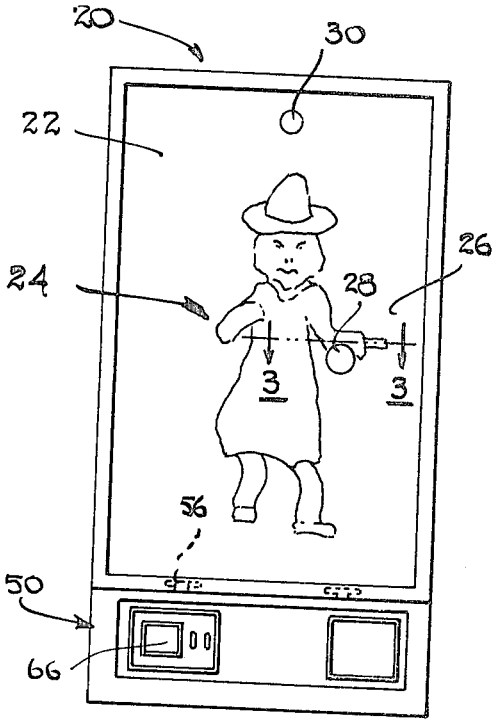
Figure 3:
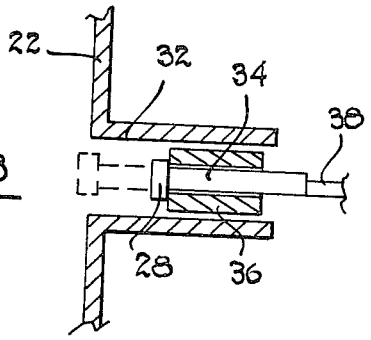
Figure 6:
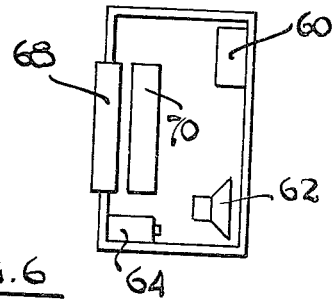
Figure 4:
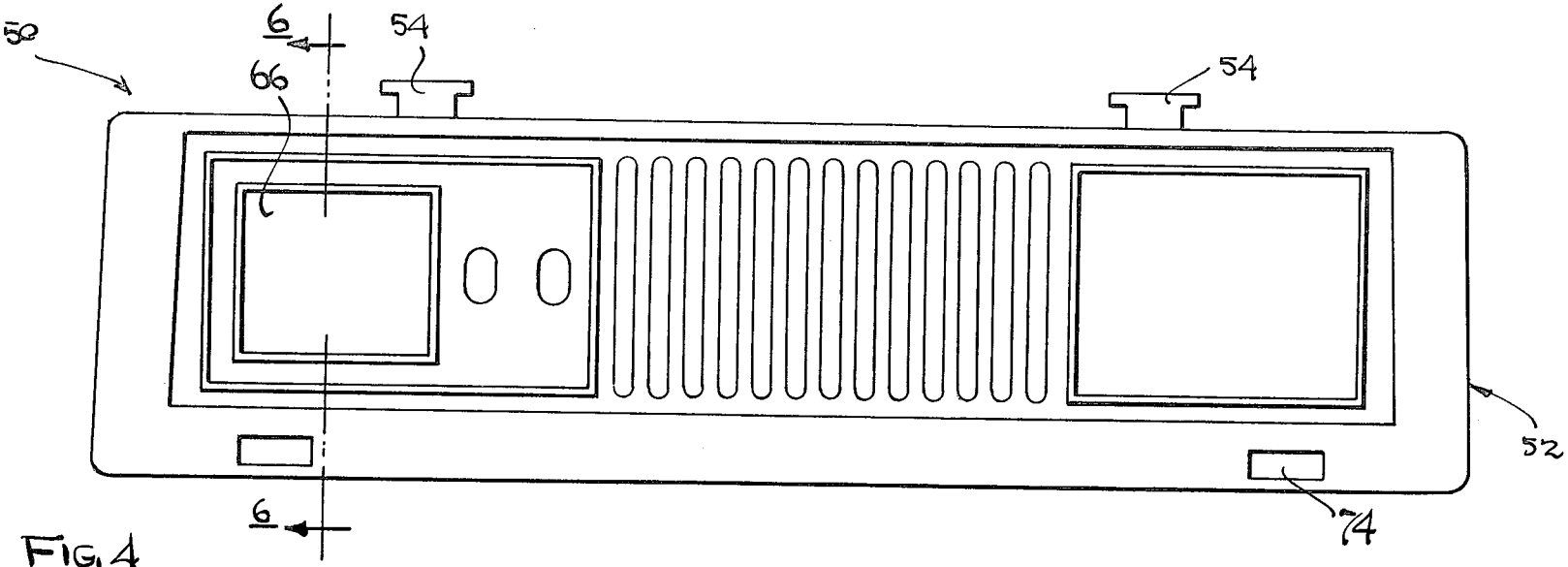
Figure 5:
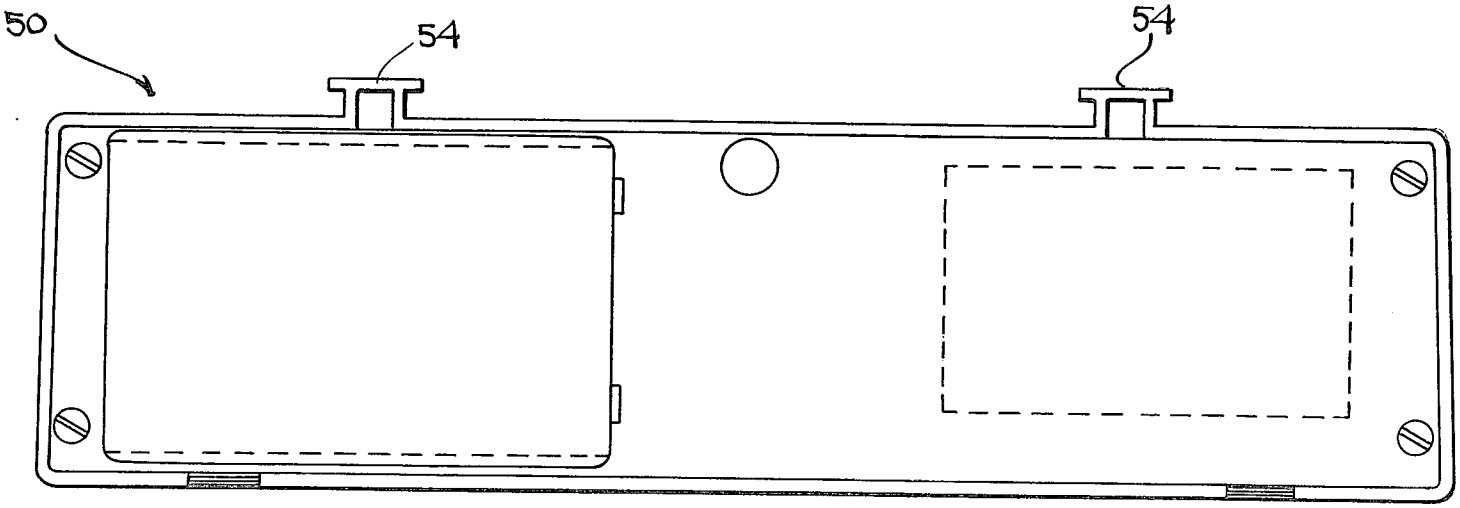
Figure 7:
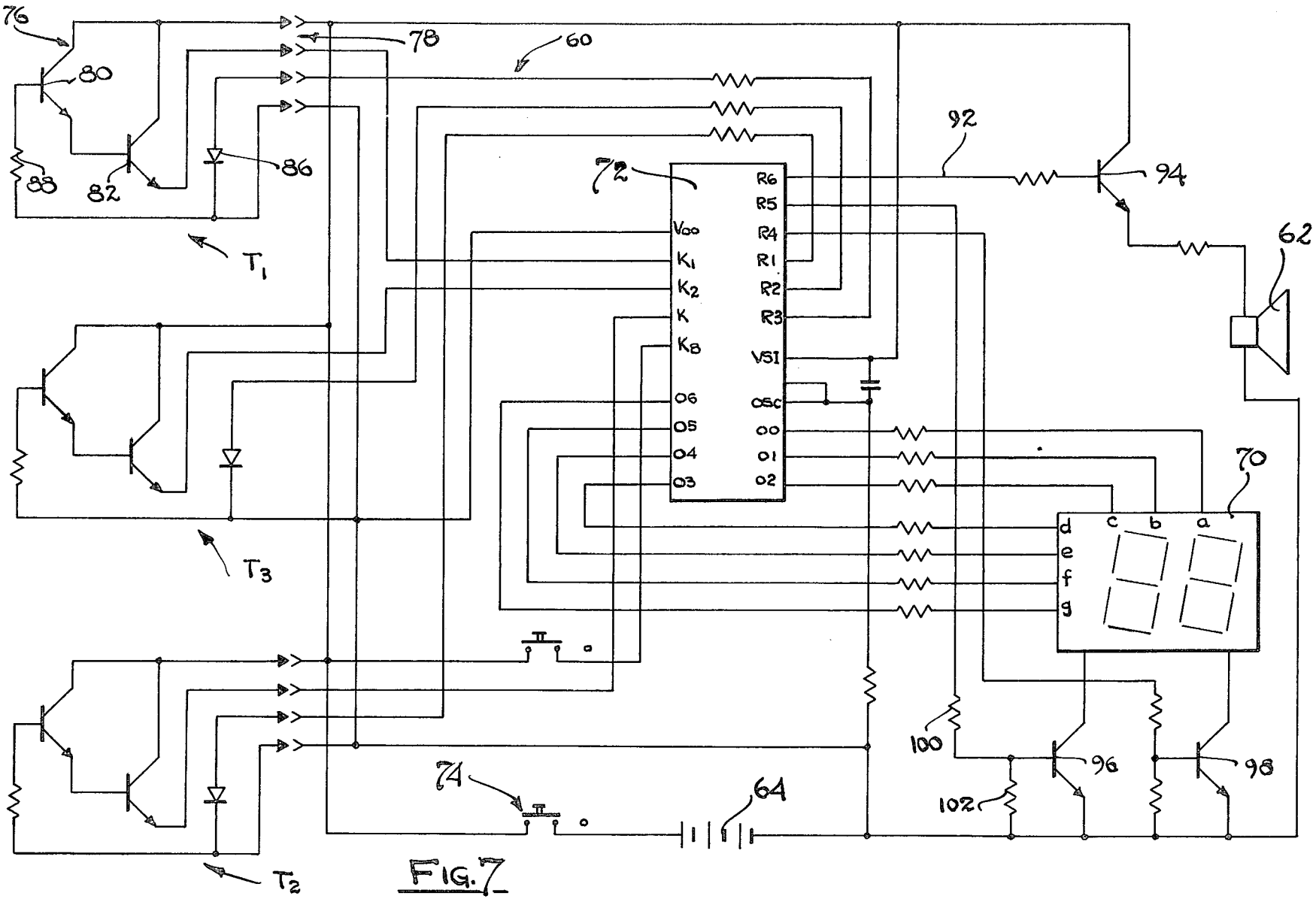
Figure 8:
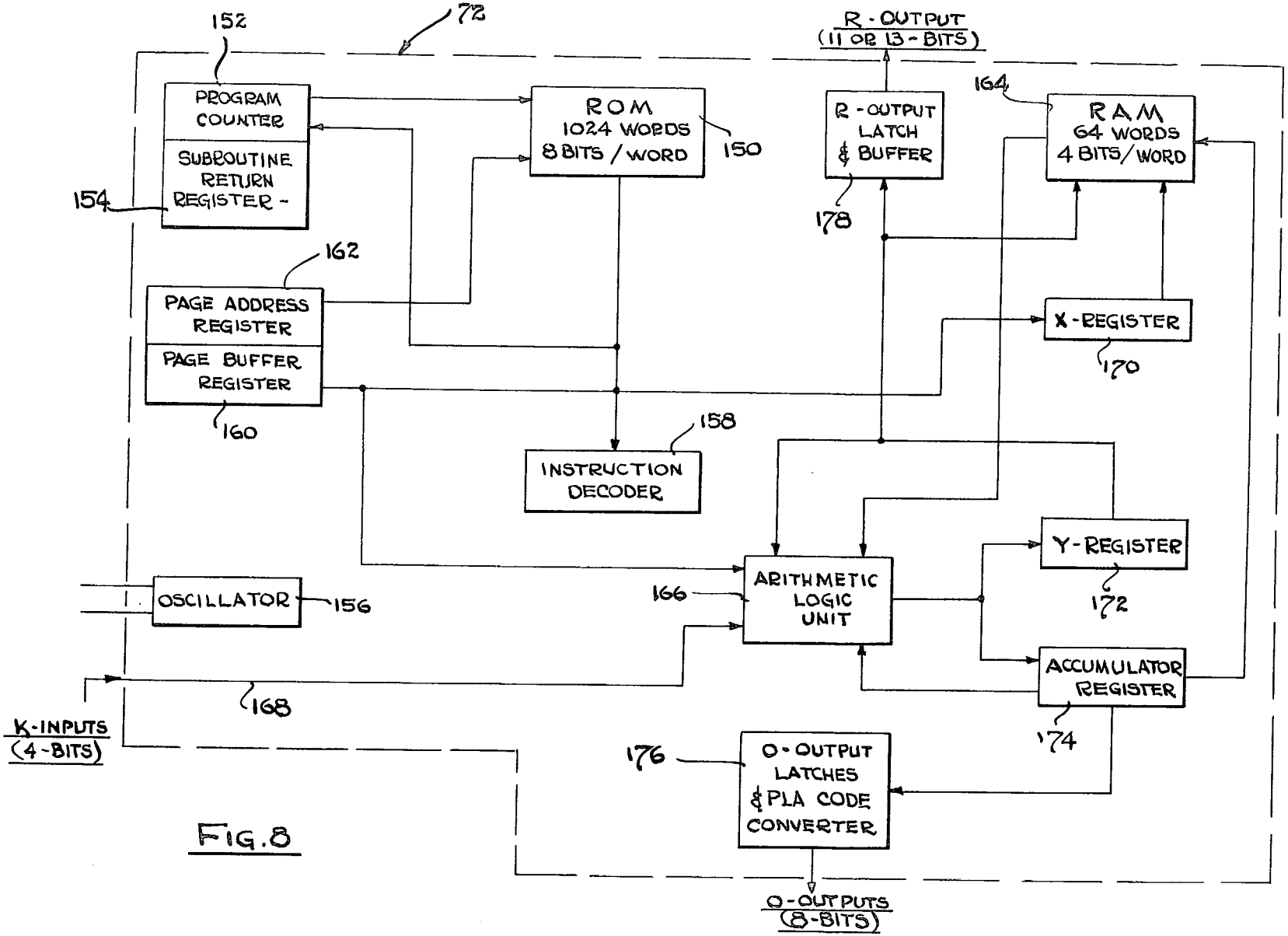

Having thus described the invention in general terms, reference will now be made to the accompanying drawings in which:

FIG. 1 is a schematic front elevational view showing the plurality of targets and shooter mechanism forming part of the game apparatus of the present invention;

FIG. 2 is an enlarged front elevational view of one of the targets forming part of the game apparatus of the present invention;

FIG. 3 is a fragmentary horizontal sectional view taken along line 3—3 of FIG. 2 and showing a means for positioning a light sensitive photoelectric cell in one of the target mechanisms;

FIG. 4 is a front elevational view of the scoring and control unit located on one of the target mechanisms of the present invention;

FIG. 5 is a rear elevational view of the control and scoring unit of FIG. 4;

FIG. 6 is a fragmentary vertical sectional view taken along line 6—6 of FIG. 4;

FIG. 7 is a schematic electrical circuit diagram showing a portion of the electrical circuit forming part of the game apparatus of the present invention;

FIG. 8 is a schematic circuit diagram showing some of the major components of the microprocessor used in the apparatus of the present invention; and FIGS. 9A–9G are schematic diagrams of a flow chart which may represent one program for use with the game apparatus of the present invention.

Figure 10A:
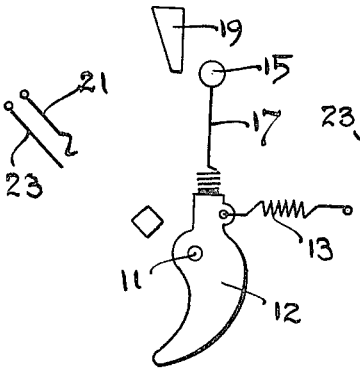
Figure 10B:
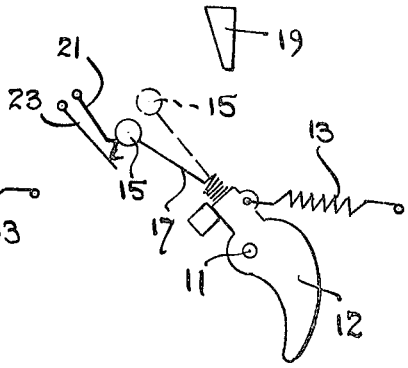

FIGS. 10A and 10B are schematic views of the trigger mechanism for the shooter.

DETAILED DESCRIPTION OF A PREFERRED EMBODIMENT

Referring now in more detail and by reference characters to the drawings which illustrate a preferred and practical embodiment of the present invention, A designates a multiple target-shooter game apparatus which is comprised of a plurality of separate target units T (three boxes, as illustrated in FIG. 1 of the drawings), along with a shooter mechanism S as also shown in FIG. 1 of the drawings.

The shooter mechanism may be in the form of various devices which are capable of generating a light beam. In this case, the shooter mechanism S adopts the form of a toy rifle having a barrel 10 and a trigger mechanism 12. Suitably located within the barrel 10 is a bulb or similar device 14 capable of generating a beam of light. The bulb 14 may be energized by means such as one or more batteries 16 located within the butt of the shooter mechanism S. It should be understood that the shooter mechanism S could be connected to the same source of electrical power which operates the targets in a manner to be hereinafter described in more detail.

Each of the target units T are similar in construction, and one of the targets T is more fully illustrated in FIGS. 2 and 3 of the drawings. In each case, the targets units T are comprised generally of a rectangularly-shaped box or housing 20 which may be provided with a decorative face panel 22 formed of glass, plastic or the like. Suitably imprinted on the face panel 22 is a suitable decorative image 24, as for example, an image of a cowboy as illustrated. The cowboy in this illustrated embodiment is provided with a hand gun 26. Moreover, a target in the form of a light sensitive photoelectric cell 28 is located in the position adjacent to the hand gun such that the player of the game apparatus will attempt to effectively shoot at the hand gun of the cowboy. In any event, it should be understood that the light sensitive photoelectric cell 28 could be positioned elsewhere on the face plate 22.

It should also be understood that a plurality of light sensitive cells 28 could be located on each of the target units and each of the light sensitive cells selectively and individually activated or otherwise activated in groups. For example, each face panel 22 may be provided with a plurality of, for example ten such light sensitive photoelectric cells, and in which two or three may be simultaneously activated, such that the player of the game apparatus attempts to quickly shoot at each of the two or three activated light sensitive cells.

Each of the target units T is also provided with some means to indicate the fact that the associated target is activated. In a preferred embodiment which is illustrated, the means to indicate that the target is activated may adopt the form of a light as for example, a light emitting diode 30. Thus, when the light emitting diode 30 is energized, the player of the game will recognize that the particular target unit T has been activated and the players should attempt to shoot at the light sensitive cell of that particular target unit. In the event that each of the target units T were provided with a plurality of such light sensitive cells, each such light sensitive cell could have an appropriate indicator as for example a separate light emitting diode to indicate which of the particular cells has been activated. Alternatively, one diode could indicate that all of the cells on that unit were activated.

The illustrated game apparatus may be provided with a speaker 62 which is operable by a microprocessor (both of which are hereinafter described in more detail). The microprocessor may be suitably programmed to cause energization of the speaker to provide appropriate sounds, e.g., beeps or the like, indicating a particular target has been activated. Moreover, the microprocessor may also be suitably programmed to cause the speaker to generate amusement tunes or the like.

The target cells may be adjusted for ambient light conditions. This includes not only general light level, but the position of lights in the area. In this regard, the light sensitive photoelectric cell 28 is capable of being positionally located axially within a tubular cell-receiving chamber 32 formed with the housing 20, in the manner as illustrated in FIG. 3. A tube may be formed integrally with or otherwise secured to the front panel 22 or otherwise formed in the housing in order to create a chamber for receiving the light sensitive cell 28. The cell 28 is secured to a rearwardly extending stem 34 which is axially shiftable within a sleeve 36 fixed within the tube 32. In this way, the position of the light sensitive cell 28 can be adjusted to account for ambient light conditions. Thus, in a room environment where there is an excess of ambient light or light is being directed at one cell, that cell can be pushed rearwardly within the tube 32 in the manner as illustrated in the solid lines of FIG. 3. In like manner, where the room is fairly dark, where there is only a small amount of light available, the light sensitive cell could be shifted forwardly to the position as illustrated in the broken lines of FIG. 3. This permits adjusting each target cell individually so that it will only respond to being impinged upon by a direct hit on the light beam. The cell 28 is connected by means of a pair of electrical conductors 38 to the microprocessor circuit.

Suitably mounted on at least one of the housings 20 is a control and scoring mechanism 50 more fully illustrated in FIGS. 4–6 of the drawings. The mechanism 50 generally comprises an outer housing 52 having a plurality of upstanding lugs 54 capable of fitting within corresponding slots 56 on the underside of one of the housings 20, in the manner as illustrated in FIG. 2 of the drawings. In this way, the lugs 54 and the slots 56 form a type of cooperating releasable locking means such that the control and score keeping mechanism 50 may be secured to one of the target units T in the manner as illustrated. In this respect, it should be observed that separate scorekeeping mechanism could be associated with each of the target units T. In the embodiment as illustrated, the control and scorekeeper mechanism 50 is secured to one of the targets units T and which is electrically connected to each of the other target units T by electrical conductors 58 in the manner as illustrated in FIG. 1. In the same respect, the shooter mechanism S could also be connected to the control and scorekeeping mechanism 50 by an electrical conductor (not shown) if desired.

Located within the housing 52 is a microprocessor 60 which is hereinafter described in more detail. In addition, a speaker 62 is suitably mounted within the housing 52 and is also of conventional construction. The microprocessor and various other components forming part of the control and scorekeeping mechanism 50 may be suitably operated by a source of stored electric energy e.g. a battery 64 as illustrated, although the mechanism could be operated by a suitable source of electrical current as for example, 110 volt AC electrical power which may be transformed to a different voltage if required.

The housing 52 is provided with an aperture 66 on its front face which is covered by a transparent shield such as a plastic or glass window 68. Immediately rearwardly of the window 68 is a display screen 70 which is in turn connected to the microprocessor 72 for displaying the scores.

As indicated previously, a separate score display mechanism may be located beneath or otherwise associated with each of the target units T. In this illustrated embodiment, the control and scorekeeping mechanism would be located in only one individual housing but connected to each of the score display mechanisms. Further, it should be understood that it is not necessary to physically attach the control and score display mechanisms to the targets as such.

The microprocessor is designed so that during the play of the game, individual target cells are activated on a random or apparently random basis. In this way, if the target cell 28 of a unit T has been energized, and cell 28 is struck by a beam of light, a score will be generated. If the cell has not been so activated, then any impingement of light on the cell will not generate a score. Further, the microprocessor may be so programed to activate each cell 28 for only a limited time period. Thus, the players of the game are required to "shoot", that is, direct a beam of light, at the activated cell within the preestablished time period and before the cell becomes deactivated. The time periods may be made relatively short, so that the players are required to keep alert and to quickly shift the light gun to aim at and shoot at the desired target as soon as the light emitting diode 30 of that target becomes energized. Failure to hit an activated target before it becomes deactivated may result in the loss of a score.

To ensure that the user will take distinct and separate shots at the targets (rather than keeping the light beam on and scanning back and forth for the alloted time during which a target is activated), each time the trigger 12 of the light beam gun 10 is pulled, the beam goes on only momentarily and then it goes off again. This is provided by means illustrated schematically in FIGS. 10A and 10B. FIG. 10A shows the trigger in the "at rest" position. The trigger 12 which is pivoted at 11, is biased by spring 13 to that position. The trigger carries a metal ball weight 15 on the upper end of a resilient support element 17. When the trigger is pulled as depicted in FIG. 10B, the ball weight 15 is thereby caused to snap past a deflector 19. The forward inertia of the ball weight 15 causes it to move against the resilient support element 17 to the position shown in solid line in FIG. 10B where it engages one contact 21 of a normally open switch and in turn moves that contact 21 into engagement with the other switch contact 23. This closes the switch to energize the source of the light beam. The movement of the trigger is stopped by block 25 at the position shown in FIG. 10B. The forward swing of the ball weight 15 past the position shown in broken line in FIG. 10B is only momentary and it immediately returns to that position. This releases the contact 21 which has made momentary engagement with contact 23, and allows contact 21 to open to the position shown in FIG. 10A. Thus, the light beam is turned on or "fired" only momentarily, and to fire again the trigger must first be returned to the "at rest" position.

The target units may preferably be connected together by long enough lines to permit the target units to be substantially spaced from each other. For example, the length of wire between units may be on the order of 6 feet. It is desirable that such length be at least 2 feet and preferably at least 4 feet so that the user cannot readily watch all the units at once and must make substantial movement when moving the shooter mechanism from aiming at one target to aiming at another.

While the illustrated shooter mechanism is not directly connected to the electronic circuit means, it could be so connected by a separate wire much in the same manner as the targets are connected.

FIG. 7 more fully illustrates one form of the electric circuit means 60 which may be used in the apparatus of the present invention. The electric circuit means 60 includes a microprocessor 72 of conventional construction which may be suitably programed in order to perform the various game functions of the illustrated game apparatus. The microprocessor 72 may exist as an integrated circuit chip and for that matter, the entire electric circuit means 60 could exist in the form of a single integrated circuit chip. The electric circuit means 60 also includes the display screen 70 which is connected to the microprocessor 72 along with the speaker 62. The electric circuit means 60 is shown connected to a source of power as for example, a 9 volt battery 64 as illustrated in FIG. 7. The means 60 further, includes a conventional off-on switch 74 mounted on the housing 52 of the control and scoring mechanism 50. In this same respect, it should be understood that other manually operable adjustments or controls could be provided.

For example, a timing control could be provided so that the players of the game apparatus may vary the time period for shooting at each activated target. Thus, players with greater age or skill may be given shorter time periods then players with lesser age or skill.

In the embodiment of the invention as illustrated in FIG. 7, two separate individual targets T are shown as being connected and forming part of the electric circuit means and which are designated as $T_1$ and $T_2$. Further, in each case, it can be observed that each target includes its own target circuit 76 which is connected to the control and score keeping mechanism 50 by means of suitable connectors 78 as schematically illustrated in FIG. 7 of the drawings. In this particular embodiment a third target $T_3$ has its own target circuit 76 physically hard-wired to the electric circuit means as illustrated.

Each target circuit generally comprises a pair of NPN transistors 80 and which are preferably 2N5779 transistors. Moreover, the emittor of each of these transistors is connected to a second NPN transistor 82 of each such target circuit which is preferably 2N3G4G transitor. In addition, a feedback circuit is provided to each target in the form of a rectifing diode 86 and a resistor 88, the latter which is preferably about 810 k-ohm resistor.

The microprocessor 72 has an output 92 directed to an NPN transistor 94 and the latter of which has its emitter connected to the speaker 62. In addition, the microprocessor 72 also has outputs connected to two additional transistors 96 and 98 which also have their emitters connected to the B- line of the circuit and their collectors connected to the display mechanism 70 in the manner as illustrated in FIG. 7 of the drawings. The inputs to each of the transitors 96 and 98 as well as the transitor 94 are provided with 470 ohm resistors 11 and in addition, the bases are connected to the B- conductor through 56 K-ohm resistors 102.

One form of microprocessor 72 which is used in the electric circuit means 60 of the present invention is more fully illustrated in the schematic block diagram of FIG. 8 and as indicated above, may exist in the form of a single integrated chip. The term "microprocessor" is generally used synonymously with the term "microcomputer". The microprocessor 72 generally comprises a read only memory or so-called "ROM" 150 which contains the storage for the program which is employed.

In one embodiment of the present invention, a microcomputer offered by Texas Instrument Company, and which exists in the form of a single integrated circuit chip designated by the trade name "TMS 1000" may be employed as the microcomputer. This particular microcircuit chip is a dedicated chip in which one layer thereof may be suitably programmed with proper program steps in order to perform the various functions of the game heretofore described. Thus, the one particular layer may be programmed in accordance with a flow diagram as hereinafter discussed. Thus, the program representative of this flow diagram is effectively introduced into the read-only memory 150.

The read-only memory 150 operates in conjunction with a program counter 152 and a sub-routine return register 154. The program counter 152 and the sub-routine return register 154 are basically designed to keep track of the instructions introduced into the read-only memory 150. The program counter initiates an input to the read-only memory 150 and the sub-routine return register 154 may function as a part of the program counter 152. The sub-routine return register is actually used to impliment the sub-routine calls in the program introduced into the read-only memory 150.

The microcomputer also is provided with a timing circuit 156 in the form of an oscillator and which generates timing signals for all of the various components illustrated in the circuit chip 72. In this case, it should be understood that the various flow lines as illustrated in FIG. 8 actually show the movement of data and do not necessarily describe the actual interconnection of the various components. In this respect, it should be understood that the oscillator 156 would essentially be connected to practically all of the components as illustrated, in order to provide the proper timing signals thereto.

The microcomputer 72 also comprises an instruction decoder 158 which receives an output from the read-only memory 150 and implements specified sequences of connection between the various components forming part of the microcomputer 72. In this respect, the program counter 152 has an output which is connected to the read-only memory 150. Further, outputs of the read-only memory 150 are introduced into a page buffer register 160 which operates in conjunction with a page address register 162, and the latter of which has an input to the read-only memory 150. The page address register 162 and the buffer register 160 are designed to further address and access data which is in the read-only memory 150.

The microcomputer 72 further comprises a random access memory 164 which is used to store variable data quantities used in various operations and which are provided for execution of the program introduced into the read-only memory 150. In this respect, the read-only memory 150 is designed to store 1,024 eight-bit words, and the random access memory 164 is designed to store 64 four-bit words. The microcomputer 72 also comprises an arithmetic logic unit 166 which is designed to receive and operate on data introduced into the read-only memory 150 in accordance with the instructions which have been introduced into the read-only memory 150. The arithmetic logic unit 166 receives data from the read-only memory 150, and further, receives data from the random access memory 164 in the manner as illustrated. In addition, information may be introduced into the microcomputer 72 through an input 168 and which is also provided for introducing information into the arithmetic logic unit 166.

The random access memory 164 operates in conjunction with an X-register 170 and a Y-register 172. The X-register 170 and the Y-register 172 are designed to address locations in the random access memory 164 and to access the memory therein. In addition, and accumulator register 174 operates in conjunction with the random access memory 164 and supplies information thereto. The accumulator register 174 operates to store data used in the execution of the program and further provides information to output latches 176. In addition, the microcomputer 72 is provided with additional output latches 178 which define the "R-outputs" and the output latches 176 provide outputs which define the "O-outputs". In this respect, the R-outputs may be either 11 or 13-bit words, whereas, the O-outputs are generally 8-bit words. The R-outputs are generally used to control the lights and the sounds, whereas the O-outputs are used to control other operating features in accordance with the flow chart previously described.

The various components heretofore described as forming part of the microcomputer receive information inputs in the manner as illustrated in FIG. 8. The software program may be embedded in the microcomputer during wafer processing by a single-level mask technique, which in essence defines the fixed read-only memory pattern.

In order to start the sequence of operation, the power to the microprocessor 72 is first initiated by turning on the off-on switch 74. The oscillator 156 will start generating the timing signals for the operation of the microprocessor 72. The program counter 152 then provides location information to enable accessing a certain location in the read-only memory 150 in which the first instruction is obtained. This instruction is then introduced and loaded into the instruction decoder 158, and this, in turn, establishes various instruction paths between the various elements of the microprocessor 72, depending upon the specific instruction itself.

The following represents a particular mode of playing the game and may be adapted as a basis of a program for the microprocessor. In the preferred embodiment, the game is turned on by the off/on switch and the game may be played in either a slow or fast mode. As indicated previously, a separate mode switch may be provided or it may be incorporated with the off/on switch. In the slow mode, the time that a target can be hit will be about double the amount of time in the fast mode.

When the game is first turned on the following conditions occur:

1. Scores initialize at 25 points.
2. The shot count, that is the number of shots permitted by the shooter mechanism is initially set to 25 shots.
3. The light emitting diodes in the targets may light sequentially in a repeating sequence of 1-2-3, 1-2-3, etc.
4. A mode starting special sound effects may be generated. A sequence of tones may be generated over the loudspeaker which may last for a limited period of time, e.g., about 8 to 10 seconds and at a tempo of about 10 hertz. When the sound effect has terminated, the game will proceed to a gun test. In this case, it is not necessary to employ a gun test although this can be provided optionally at the selection of the manufacturer of the game apparatus.

The program of the microprocessor may be adapted to permit the player to have a chance to make one or more practice shots at the end of the sound effect previously described. At this point, the target light emitting diodes will stop scanning or lighting and become blank and no sounds will be generated. Thus, the light emitting diodes in one of the targets will be energized, and the player will have an opportunity to attempt to hit the light sensitive cell of that target as a test shot. When the target has been hit, the game will continue to the ready state, and the score display will light again thereby showing a score of 25.

In the ready state, there is an actual start of a play cycle. The duration of the ready state is randomly selected by the microprocessor to be from about a 1 to 4 second duration, in increments of about $\frac{1}{4}$ second. It is also of importance that no target inputs be active during this interval. In other words, if a player should hit one of the target sensors with the light beam there will be no effect. At this point, the microprocessor will immediately move to a "GO" state.

The end of the ready state will be signified by either lights and/or a sound generated from the speaker in the form of a continuous tone, and this will signify the beginning the "GO" state. The target is randomly selected by the microprocessor and the time that the target remains active is also randomly or apparently randomly selected by the microprocessor to be from about 1 to 2 seconds. The target inputs will all be enabled in the "GO" state, and the player must try to hit the target which has the light emitting diode on by using the shooter mechanism. In connection with the above, if the game has been put into the slow mode, then the "GO" time will be in the range of about 2 to 4 seconds.

If the target is hit before the end of the "GO" time, the player will win a score, and that score will be increased by one. In like manner, the shot counter will be decreased by one. For a hit, a special effect may occur which may be a blinking of the light emitting diode at the rate of about 1 hertz and a descending tone sequence sound effect generated over the speaker. If a player misses a shot, and he or she fails to hit the target in time, or hits the wrong target, the player will lose a shot. In this case, the score will be decremented by one, and the shot counter will similarly be decremented by one. The target light emitting diode will de-energize and a buzz sound may be generated over the loudspeaker for about e.g., 2 seconds. The play will then resume at the next ready state.

The microprocessor is programmed to continue the above described operation with the exception of the test mode until one of the following conditions is reached:

1. The shot counter decrements to a zero level, and then the game ends.
2. The score becomes zero which also causes an end of the game.
3. A score of e.g. 50 or greater is reached, which automatically causes the start of the next mode, as for example, Mode 2.

When the game ends, the control and scoring unit may simply blink the score on and off at a rate of about $\frac{1}{2}$ hertz. No sound is generated at this time although the targets may remain on. This state may remain until the game is started again by either a reset switch which may be provided on the game, or otherwise by turning the off/on switch first off and then on again.

The play in Mode 2, that is the slow mode, is similar to that of Mode 1 except for the following:

1. Each hit in Mode 2 may count as two points, and the microprocessor is programmed to advance the score by two points. A miss may still be a minus one point.
2. There are no bonus shots available in Mode 2 which could be provided in Mode 1.
3. The play will continue until all twelve shots are made. At this point, the score is checked, and if the score is equal or greater than 70, play will continue to the Mode 3 round. If the score is less than 70, the game may be over.

In Mode 3, there may be a "Sudden Death" type of playoff. Each hit in Mode 3, that is a proper light sensitive cell has been contacted by a source of light, will count for five points, and there are no bonus shots available. The first miss in Mode 3 may then immediately end the game. The miss may be designated by a sound generated over the speaker, and the game will end. If all five shots constitute hits, and the player has reached a score of 99, the game will end.

In the play of the first mode, a bonus shot may occur every four to six games cycles, and which will be randomly selected by the microprocessor. When a bonus is enabled, a hit will count for about two points. However, the "GO" time duration will be cut in about one-half from what it would be if the shot was a normal one. The bonus shot is announced to the player by a certain tone generated over the loudspeaker which may be a warbling tone.

The above description which constitutes a basis of a program for the microprocessor actually represents the flow charts of FIGS. 9A through 9G. In this case, the flow charts may illustrate some program steps not necessarily discussed in detail in the foregoing description since the illustrated steps are generally explanatory and define implementation for a program to be used with the microprocessor forming part of the game apparatus.

In the flow diagrams constituted by FIGS. 9A through 9G, the term GOGRP represents "go-group" which is a sequence of steps defining a "go" operation, that is a time in which one or more of the active targets may be hit. The term "SNDGEN" represents sound generator and is a sequence of steps which again are used to initiate sound over the speaker forming part of the apparatus. The term "KEEPGO" represents a sequence of steps which defines an operation which is a continuation of the "go" operation. The term "buzzer" is used in the accompanying FIGS. 9A–9G. In essence, a separate buzzer could be employed in the apparatus of the present invention although this term is merely used to represent a program sequence which causes the speaker to generate a "buzzing" sound. The term "INIT" is an abbreviation for the term initiate.

Figure 9A:
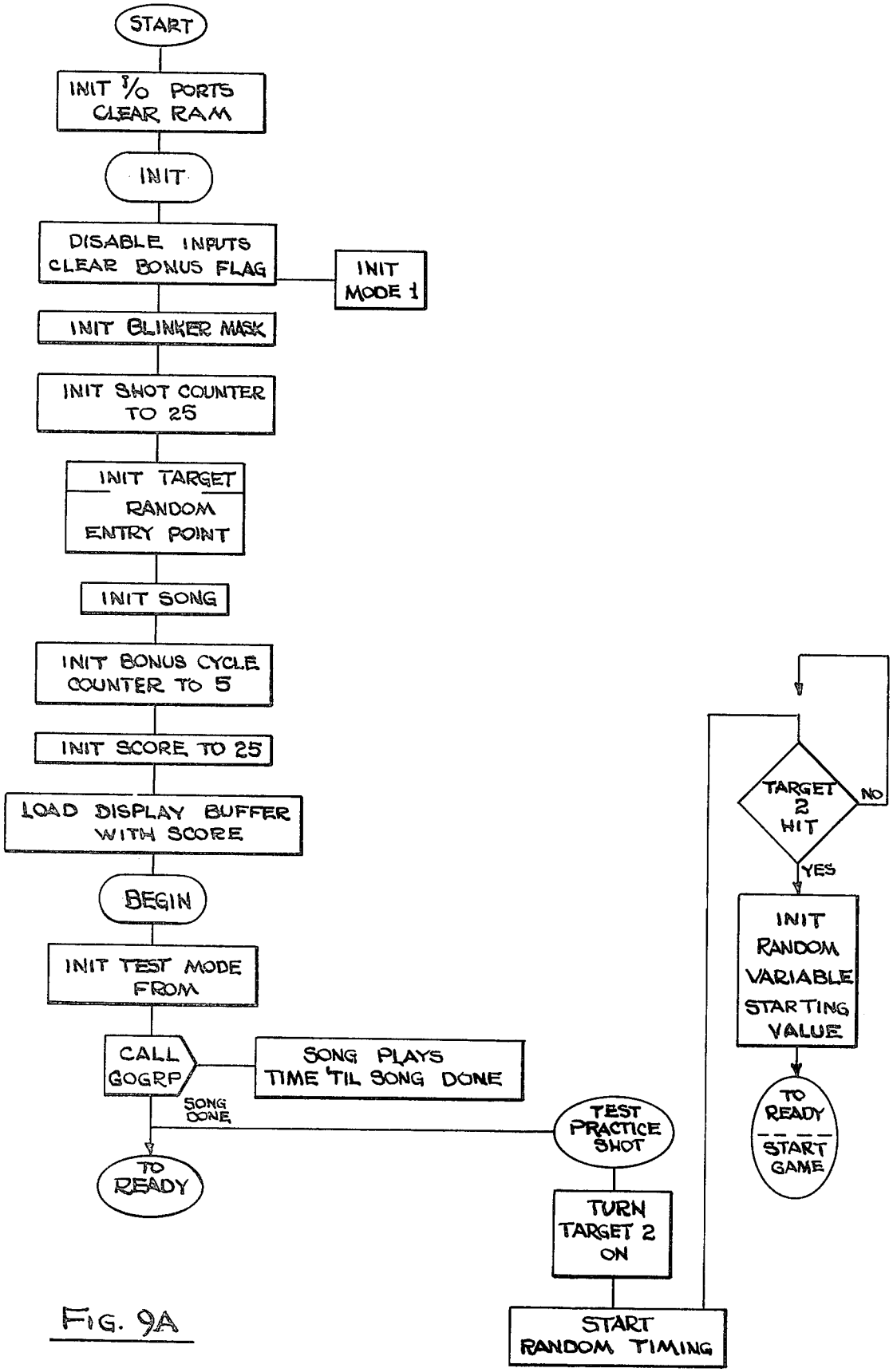

In FIG. 9A there are a series of steps which are taken in order to initiate the game apparatus prior to a playing of the game. In this case, several prepatory steps as for example, the initiating of the shot counter, the clearing of the bonus flag and the like occurs. More importantly, it can be observed that a bonus cycle counter which is programmed into the microprocessor may be initilized to a count of e.g., five and the scores may be initilized to a score of e.g., twenty-five.

Further, FIG. 9A also discloses a sequence of steps relating to a test practice shot for each of the players. This sequence of steps can be eliminated although, they may be included in the program if desired.

Figure 9B:
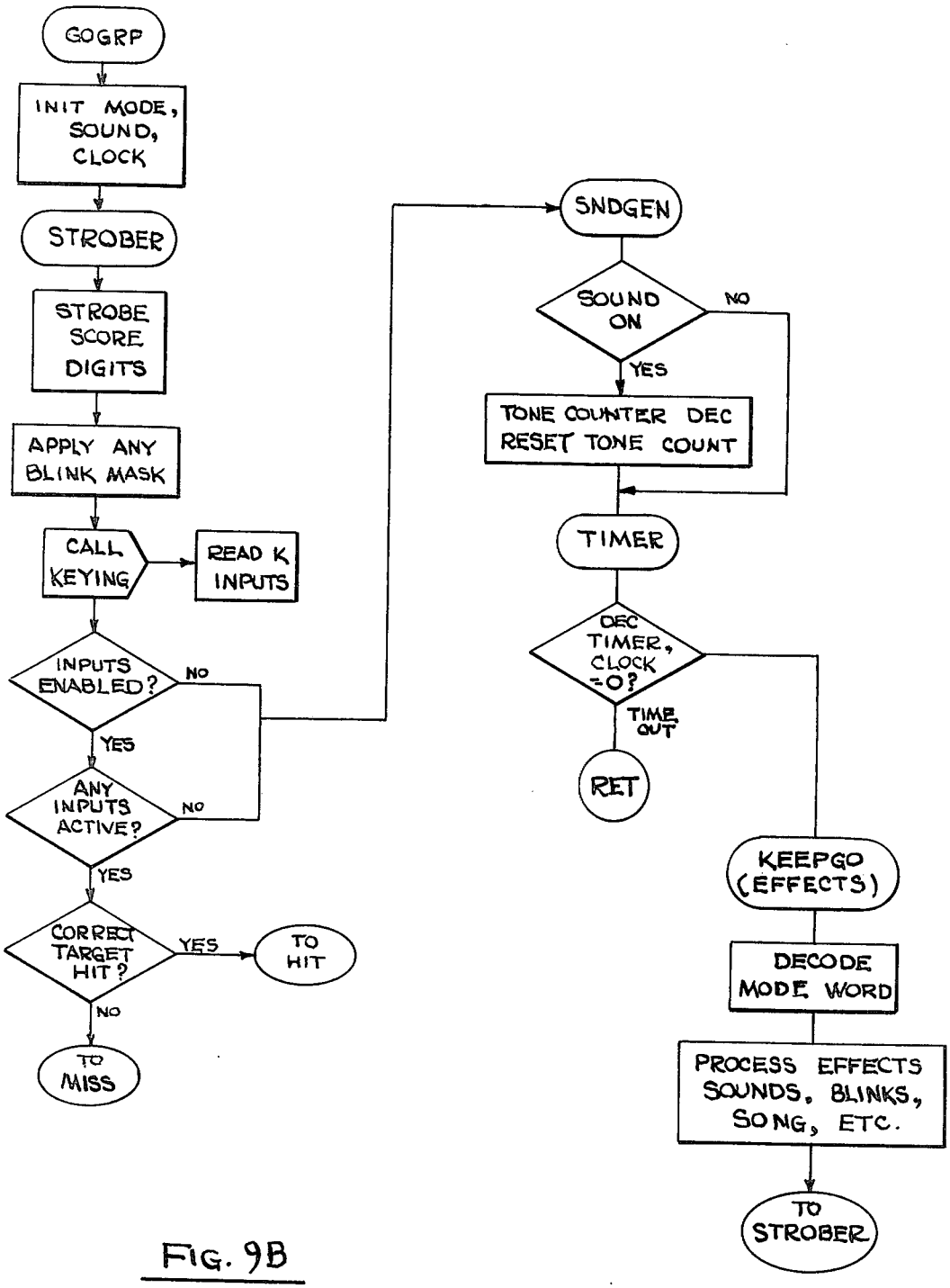
Figure 9C:
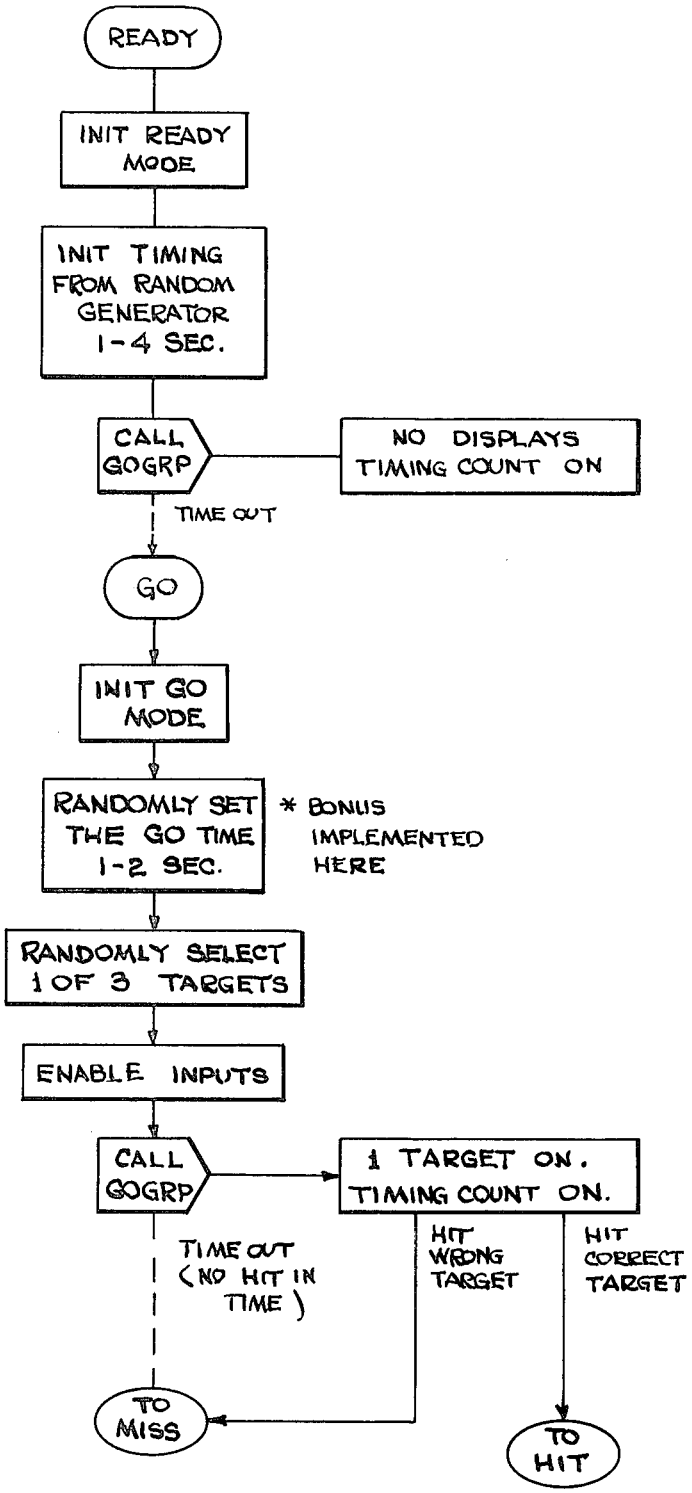

In FIGS. 9B and 9C, one of the "go" operations is more fully described. In the case of the "go" group it can be observed that the various inputs to the processor are consequently strobed. The microprocessor effectively looks for shots which might occur when any one or more of the targets are activated. Thus, if a light beam is directed to a target which is not activated, during the "go" period, that is the predetermined time period in which a shot can be scored on the proper target, then the microprocessor will detect a missed shot. In like manner, if none of the target cells are contacted by the beam of light, then the microprocessor will detect no direct hit or shot. This strobbing only occurs in the "go" stage. During the go period, it can be observed that a decrement timer finally reaches a clock level of zero at which time the go period comes to an end. It can also be observed that the targets are randomly selected by the microprocessor. Specifically, there is any number of techniques could be used for randomly selected any one of the plurality of targets.

Figure 9D:
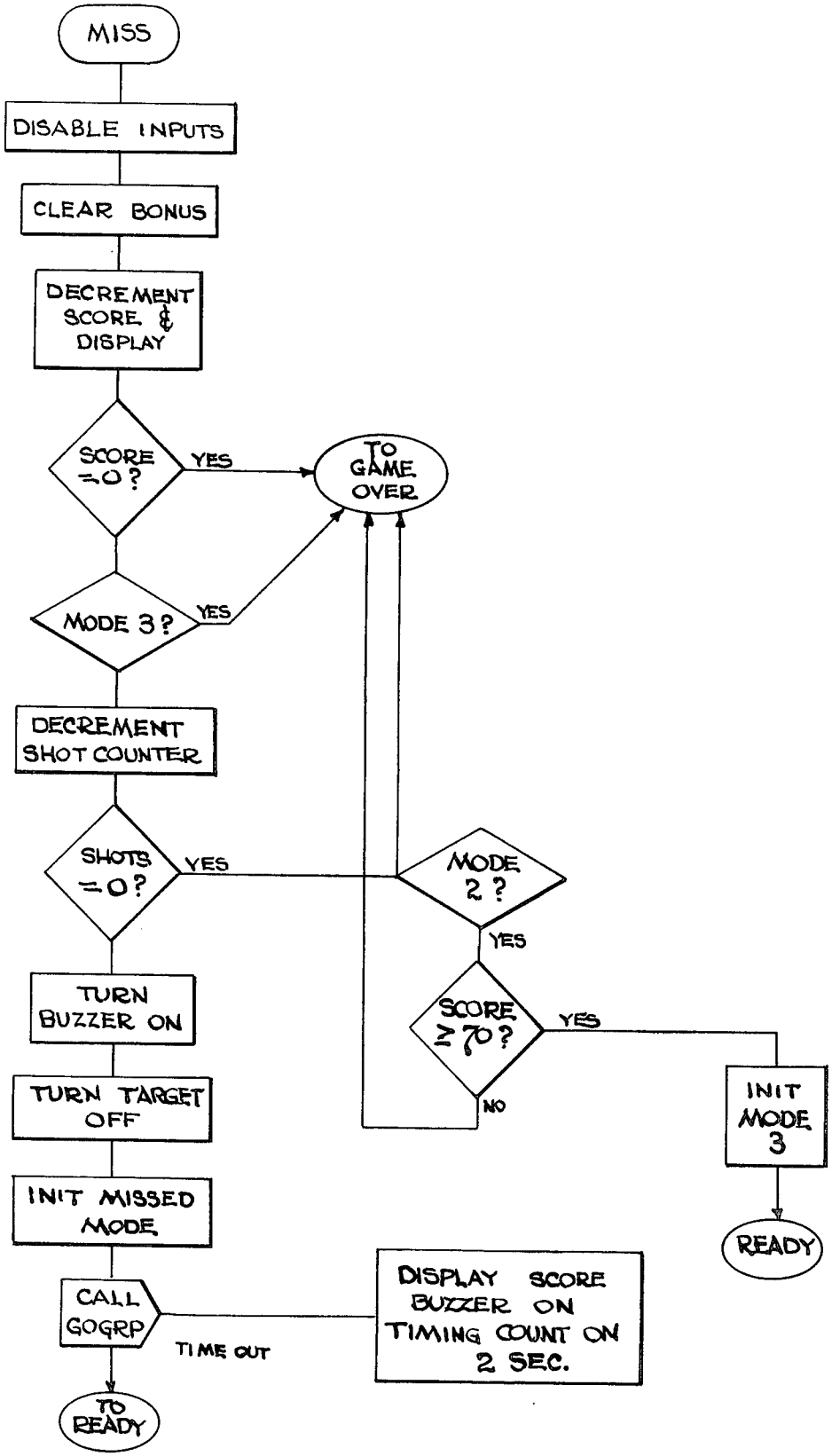
Figure 9E:
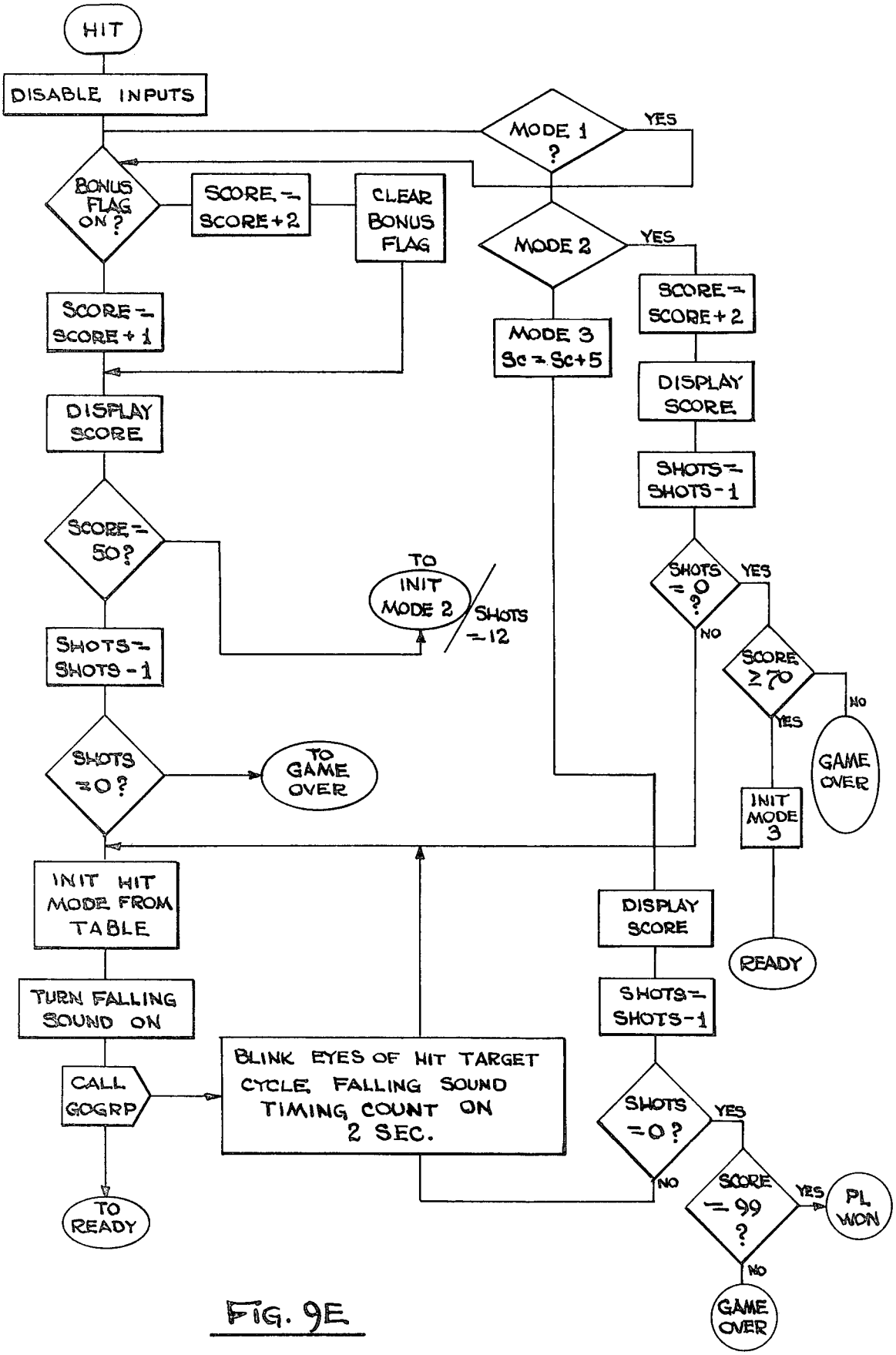
Figure 9F:
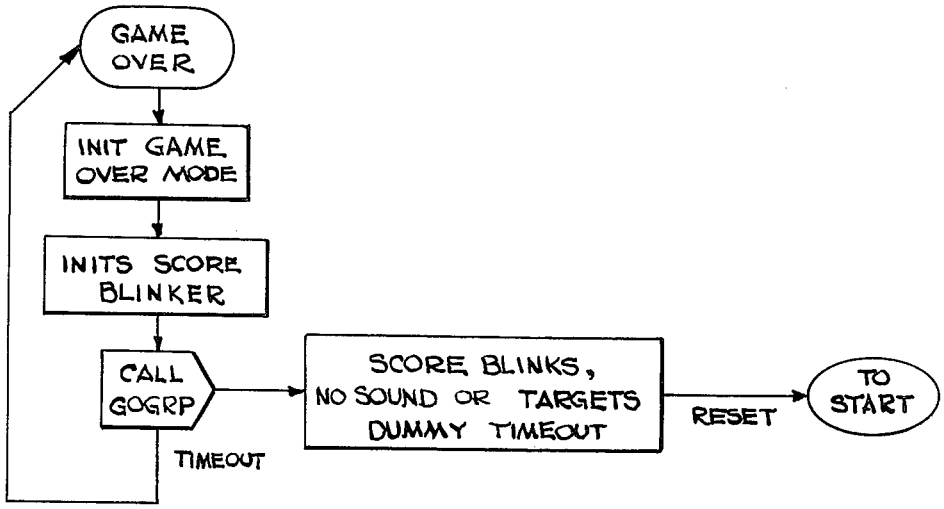
Figure 9G:
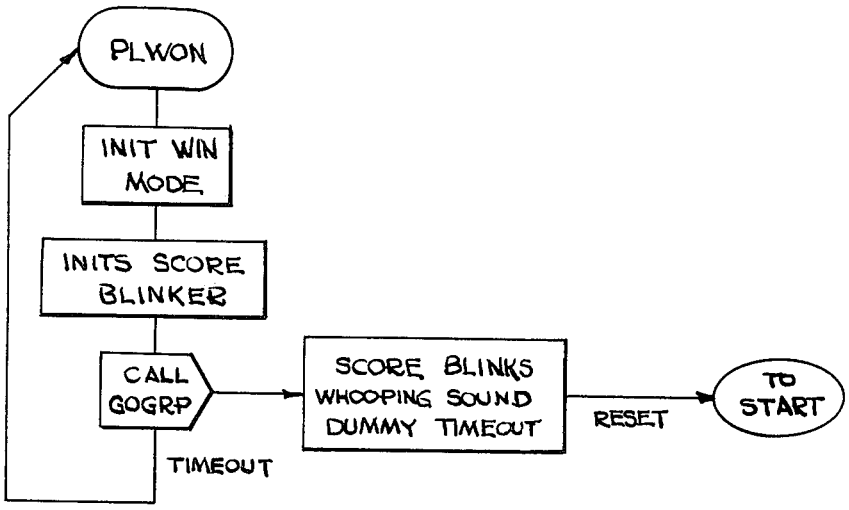

In FIG. 9D, it can be observed that modes 2 and 3 may be initiated after a completion of mode 1. There again, it is not necessary to use modes 2 and 3 which merely continue the play in different forms. Thus, it is possible to end a particular game after the play of mode 1.

Thus, there has been illustrated and described a unique and novel time reaction game apparatus in which a player attempts to shoot at each of a plurality of targets as quickly as possible when the targets are randomly activated to thereby achieve a score, and which therefore fulfills all of the objects and advantages sought therefor. It should be understood that many changes, modifications, variations, and other uses and applications of the time reaction game apparatus will become apparent to those skilled in the art after considering this specification and the accompanying drawings. Therefore, any and all such changes, modifications, variations, and other uses and applications which do not depart from the nature and spirit of the invention are deemed to be covered by the invention which is limited only by the following claims.

Having thus described my invention, what I desire to claim and secure by Letters Patent is:

1. A multiple-target shooter game apparatus comprising:

(a) a light beam shooter device disposed at a shooter position and freely moveable by a player to permit said shooter device to be aimed at individual ones of stationary prepositionable multiple targets by traversing through a wide scanning area of at least 90° up to approximately 180°, to enable the player to selectively direct the light beam in a plurality of different directions from said shooter position;

(b) a plurality of separate self-contained frames constituting said multiple targets each including self-standing means for supporting said frame in a stationary upright position facing toward said shooter position to enable the positioning of each of said frames in various different pre-positioned locations selected by the player and spaced apart one from another through a wide scanning area of at least 90° thereby allowing a player to arrange said frames into a plurality of distinctly different arrays wherein each of said frames may be spaced a different distance from said shooting position and from each other in virtually any combination of vertically displaced positions throughout a horizontal scanning area of at least 90° up to 180°;

(c) a target positioned on a front surface of each of said separate frames said target including a light sensitive photoelectric cell for being engaged by the light beam from said shooter device;

(d) electronic control means operably connected to each of said targets for activating for a short space of time and then deactivating different ones of said photoelectric cells in a random sequential order not known in advance by the player, and including sensing means for requiring the player to shoot said light beam shooter device accurately at the activated target in order to score;

(e) separate indicator means on each of said targets and coupled to said control means for indicating that the photoelectric cell of the associated target is activated so that the player must visually scan all of said frames and the individual indicating means associated therewith throughout a wide scanning area of at least 90° to determine which of said targets is activated before quickly turning in the proper direction and aiming said shooting device at the randomly activated target in order to engage said photoelectric cell associated with the activated target with the light beam before said target is deactivated; and (f) electrical connector wires means operationally connecting said photoelectric cells and said indicator means with said electronic control means, said wires means designed and arranged for permitting said separate frames to be prepositioned by the player in physically disparate locations including positions wherein the respective front surfaces of some of said frames are at least partially facing each other while at the same time all of said frames are facing said shooter position.

2. The apparatus of claim 1 further characterized in that said electrical connector wires means between each of a pair of said target means is at least about four feet in length.

3. The apparatus of claim 1 further characterized in that said electronic means includes score indicating means to indicate score based on the light beam engaging the activated photoelectric cells of said target, said score indicating means comprises a visual display means.

4. The apparatus of claim 1 further characterized in that said electronic control means is operably mounted in a separate housing which is secured to said target.

5. The apparatus of claim 1 further characterized in that said electronic control means comprises a microprocessor.

6. The apparatus of claim 1 further characterized in that said frame comprises a front face and a chamber attached to said front face, said light sensitive photoelectric cell being positionally located in said chamber to adjust the amount of ambient light impinging on said cell.

7. The apparatus of claim 1 wherein each of said light sensitive photoelectric cells is provided with an individual manually operable mechanical means for selectively adjusting the position of the cell to adapt to surrounding light levels and conditions.

8. The apparatus of claim 1 further characterized in that said apparatus comprises sound generating means operably connected to said electronic means and activated thereby for providing auditory messages such as scores or amusing sounds or the like.

9. The apparatus of claim 1 further characterized in that said shooter device has the shape and characterization of a firearm.

10. The apparatus of claim 5 further characterized in that said microprocessor is programmed to add a point to a score when a player properly directs a light beam to an activated cell and subtracts a point from a score when a player does not properly direct a light beam to an activated cell.

11. The apparatus of claim 1 further characterized in that at least one of said target means comprises a frame means hangable from a wall.

12. The apparatus of claim 1 further characterized in that said target means comprises a means to replace a picture.

13. The apparatus of claim 1 wherein said shooting device includes means to transmit a light beam, a manually actuable trigger member and means operable each time the trigger is actuated to energize said light beam transmitting means but only a moment.

* * * * *